US005903935A

United States Patent [19]

Huelke

[11] Patent Number: 5,903,935

[45] Date of Patent: May 18, 1999

[54] BATHING TRANSFER TROLLEY

[75] Inventor: David R. Huelke, Ann Arbor, Mich.

[73] Assignee: Rebecca M.K. Huelke, Ann Arbor, Mich.

[21] Appl. No.: 08/978,727

[22] Filed: Nov. 26, 1997

Related U.S. Application Data

[60] Provisional application No. 60/031,835, Nov. 26, 1996.

[51] Int. Cl.[6] ..... A47K 3/12

[52] U.S. Cl. ..... 4/560.1; 4/578.1

[58] Field of Search ..... 4/560.1, 578.1, 4/579

[56] References Cited

U.S. PATENT DOCUMENTS 4,091,479 5/1978 Hancock ..... 4/560.1

4,253,203 3/1981 Thomas ..... 4/560.1 X 4,359,791 11/1982 Thomas ..... 4/560.1 X

*Primary Examiner*—Robert M. Fetsuga

*Attorney, Agent, or Firm*—Gifford, Krass, Groh, Sprinkle, Anderson & Citkowski, P.C.

[57] ABSTRACT

A bathing transfer trolley for transferring a person from a loading region to a bathing region. The bathing transfer trolley has a frame including a rail assembly supported in a generally horizontal position by at least two legs. The rail assembly includes two transfer rail segments extending from the loading region to the bathing region. A movable seat is supported by rollers on the transfer rail segments allowing it to move from the loading region to the bathing region. The seat includes a seat bottom, an optional detachable seat back and may be pivotally mounted for rotation around a vertical axis. The legs are pivotally attached to the rail assembly allowing the legs to be folded into storage and transport of the bathing transfer trolley.

21 Claims, 5 Drawing Sheets

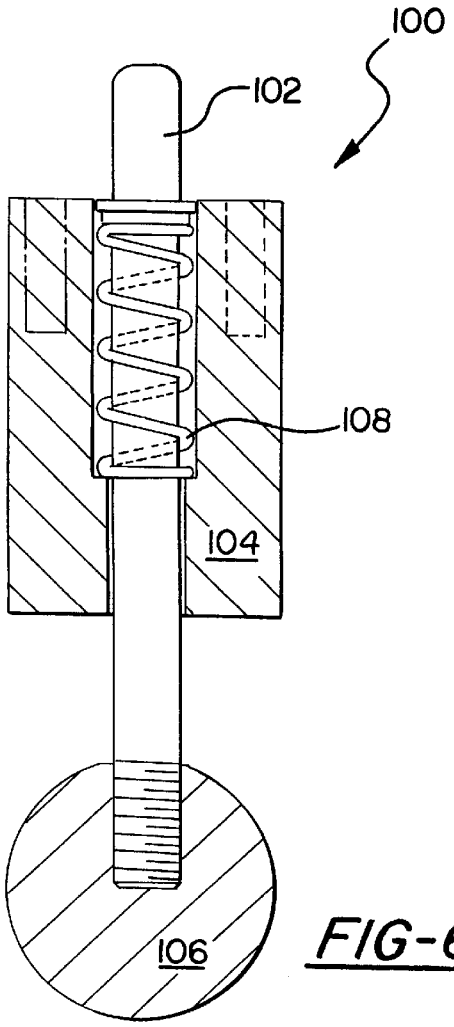
FIG-6
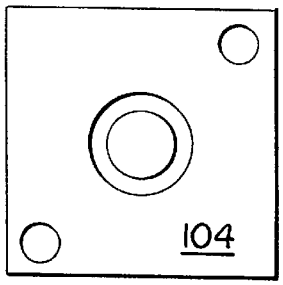
FIG-7
FIG-8
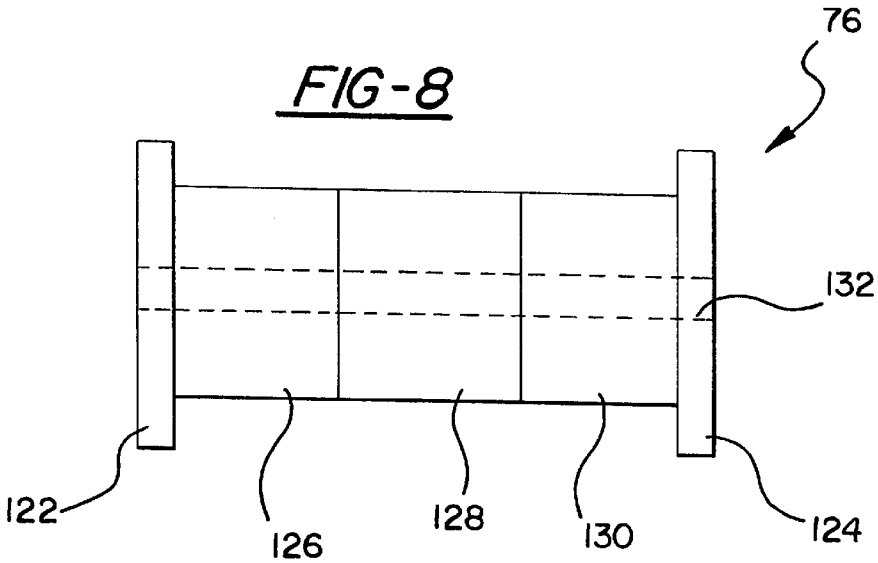

BATHING TRANSFER TROLLEY

CROSS-REFERENCE TO RELATED APPLICATIONS

This application claims the benefit of U.S. Provisional Application having Ser. No. 60/031,835 filed Nov. 26, 1996.

FIELD OF THE INVENTION

This invention relates generally to devices to assist persons with physical impairments and more specifically to a bathing transfer trolley to facilitate movement of a seated person from outside a bathtub to a position over the bathtub where the person is bathed.

BACKGROUND OF THE INVENTION

Persons with physical impairments face special challenges in accomplishing some of the ordinary tasks in daily life. A variety of devices such as wheelchairs and grab rails are available to assist those with physical impairments to accomplish these daily tasks. One of the most challenging tasks for those with physical impairments and for those that care for them is the task of bathing. A person with a physical impairment may find it very difficult or impossible to get in and out of a bathtub or shower. This task remains difficult even when assistance is available. Therefore, there is a need for a device which allows a person to be easily moved into and out of a bathtub or shower and to be comfortably supported while bathing.

In many cases, a person with physical impairments shares living quarters with other persons who do not require assistance in bathing. Therefore, it is desirable that any device designed to assist the person with physical impairments not present an obstacle to other persons sharing the living quarters who may also wish to use the bathtub or shower. For this reason, it is desirable that a bathing assistance device be easily removed from the bathtub or shower area when not in use. It is also desirable that the assistance device be easily stored and transported so that it may be taken with the user when he or she travels or is moved to a new location. These criteria make it desirable that the assistance device be light in weight and as compact as possible.

Previous approaches to providing assistance devices for bathing have fallen into two categories: permanent installations and temporary or removable devices. Permanent installations, as the name implies, entail a physical alteration of the room in which the bathing area is located to allow the permanent installation. These devices also necessarily are not easily moved to a new location or taken along on a vacation. They may also present an obstacle to other users.

Previous approaches to temporary installations have all fallen short of providing ease of use and ease of removal, storage, and transport. U.S. Pat. No. 4,091,479 to Hancock discloses a bathing seat which lacks the ability to fold for storage or transport. The design also uses only one transfer rail making it very difficult to provide a movable seat that is both easy to move and sufficiently stable to support a patient during transfer and bathing. U.S. Pat. Nos. 4,253,203 and 4,359,791 to Thomas show a cumbersome transfer trolley that lacks a pivoting seat. This shortcoming makes the Thomas transfer bench difficult to get on and off. The Thomas transfer bench does allow the bench to fold but does not do so easily and presents a cumbersome package.

SUMMARY OF THE INVENTION

There is disclosed herein a bathing transfer trolley designed to transfer a person from a loading region to a bathing region. The bathing transfer trolley has a frame which includes a rail assembly and at least two legs to support the rail assembly in a generally horizontal position. The rail assembly includes two transfer rail segments extending from the loading region to the bathing region. A movable seat has a base which includes two rollers which engage each of the transfer rail segments allowing the movable seat to move along the rail segments from the loading region to the bathing region. A seat bottom is supported by the base. In some embodiments, the seat bottom is supported by the base for rotation about a vertical axis. In other embodiments, the legs are pivotally attached to the rail assembly so that the legs may be folded against the rail assembly to ease storage and transport of the bathing trolley. In yet other embodiments, the movable seat includes a detachable seat back supported generally perpendicular to the seat bottom.

BRIEF DESCRIPTION OF THE DRAWINGS

The present invention will be more fully understood by reference to the following detailed description of the preferred embodiment of the present invention when read in conjunction with the accompanying drawings, in which like reference characters refer to like parts throughout the views and in which:

FIG. 6 is a top view of the locking device portion of the bathing transfer trolley according to the present invention;

FIG. 7 is an end view of the locking device of FIG. 6; and

FIG. 8 is a detail view of a roller for the bathing transfer trolley according to the present invention.

DETAILED DESCRIPTION OF THE PREFERRED EMBODIMENT

Figure 1:
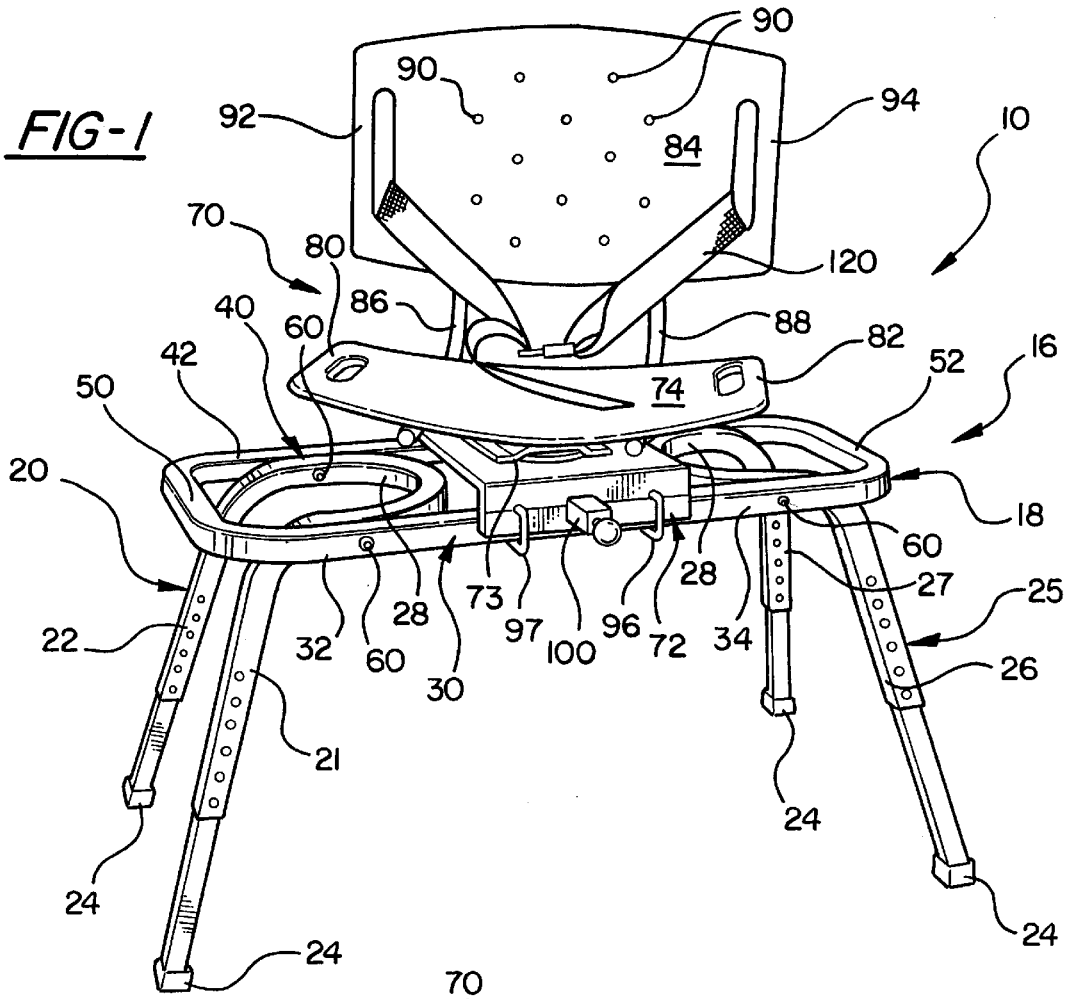
FIG. 1 is a perspective view of a bathing transfer trolley according to the present invention in its ready to use position.
Figure 2:
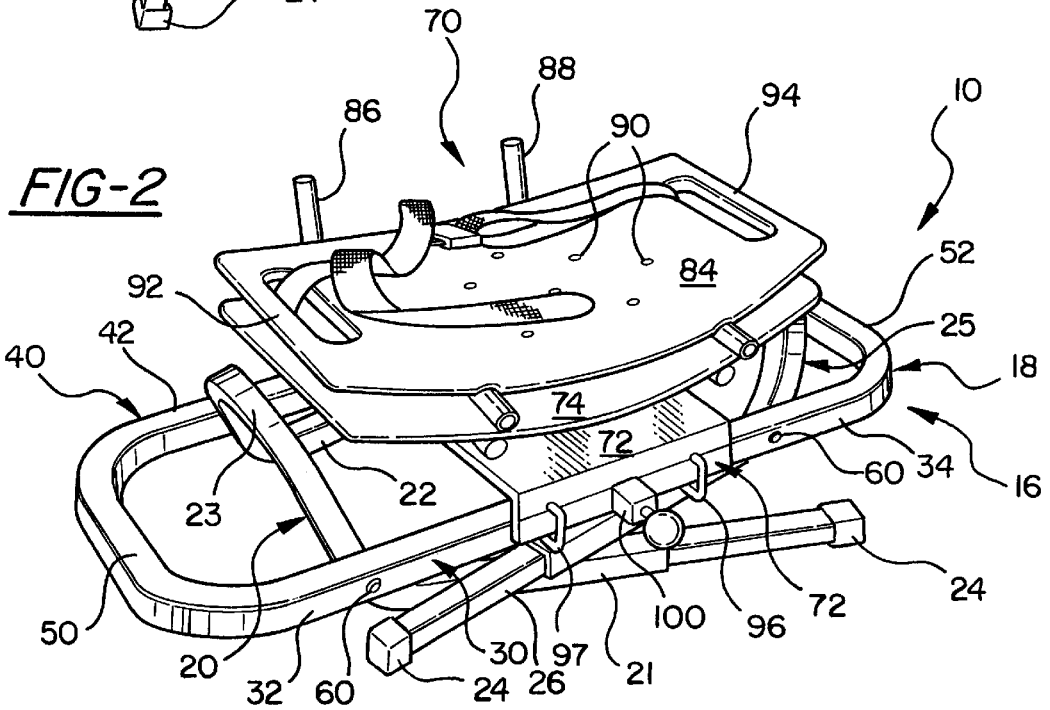
FIG. 2 is a perspective view of the bathing transfer trolley in its ready to transport position with the legs folded and the seatback removed ready for transportation or storage.
Figure 3:
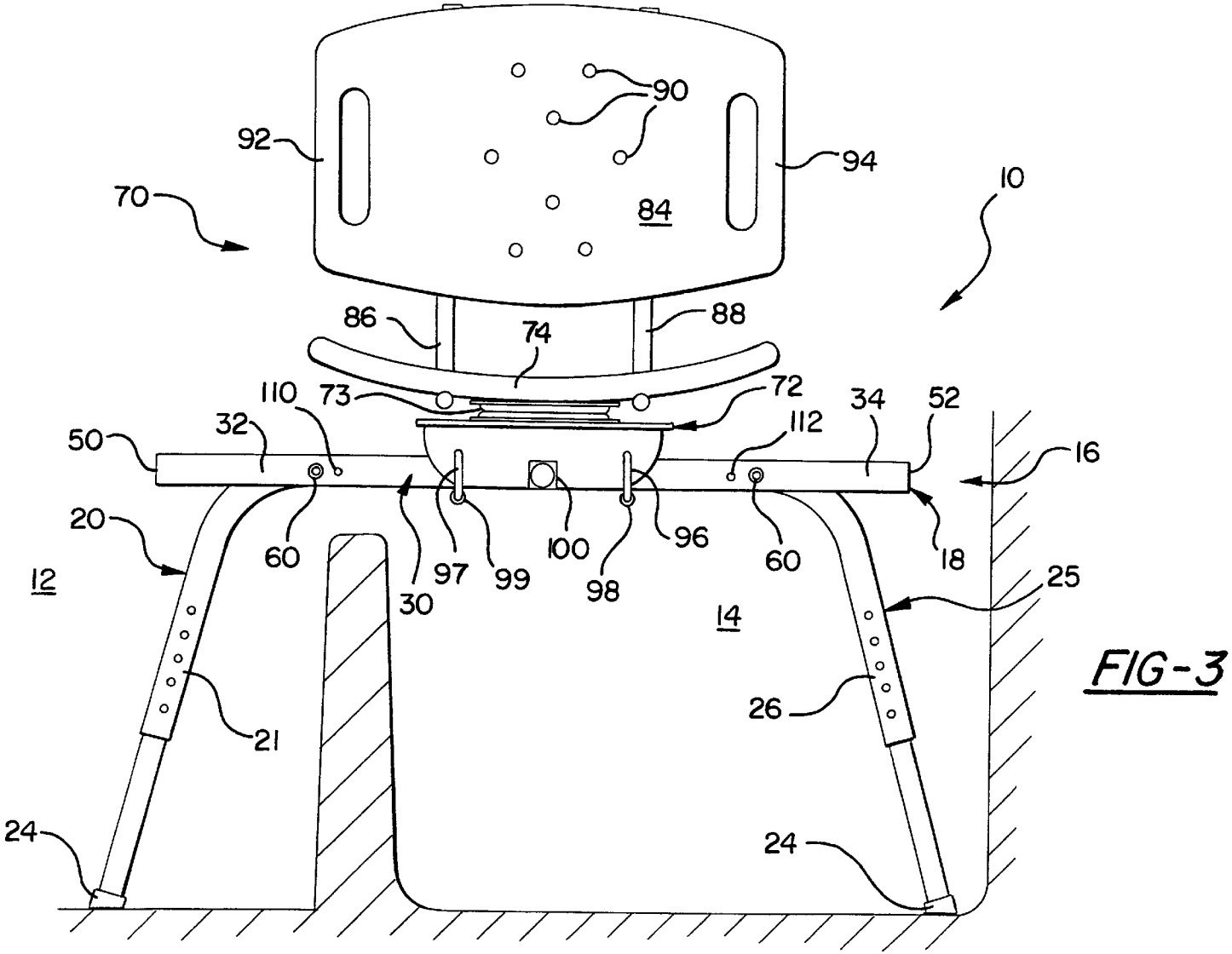
FIG. 3 is a front elevational view of the bathing transfer trolley.
Figure 4:
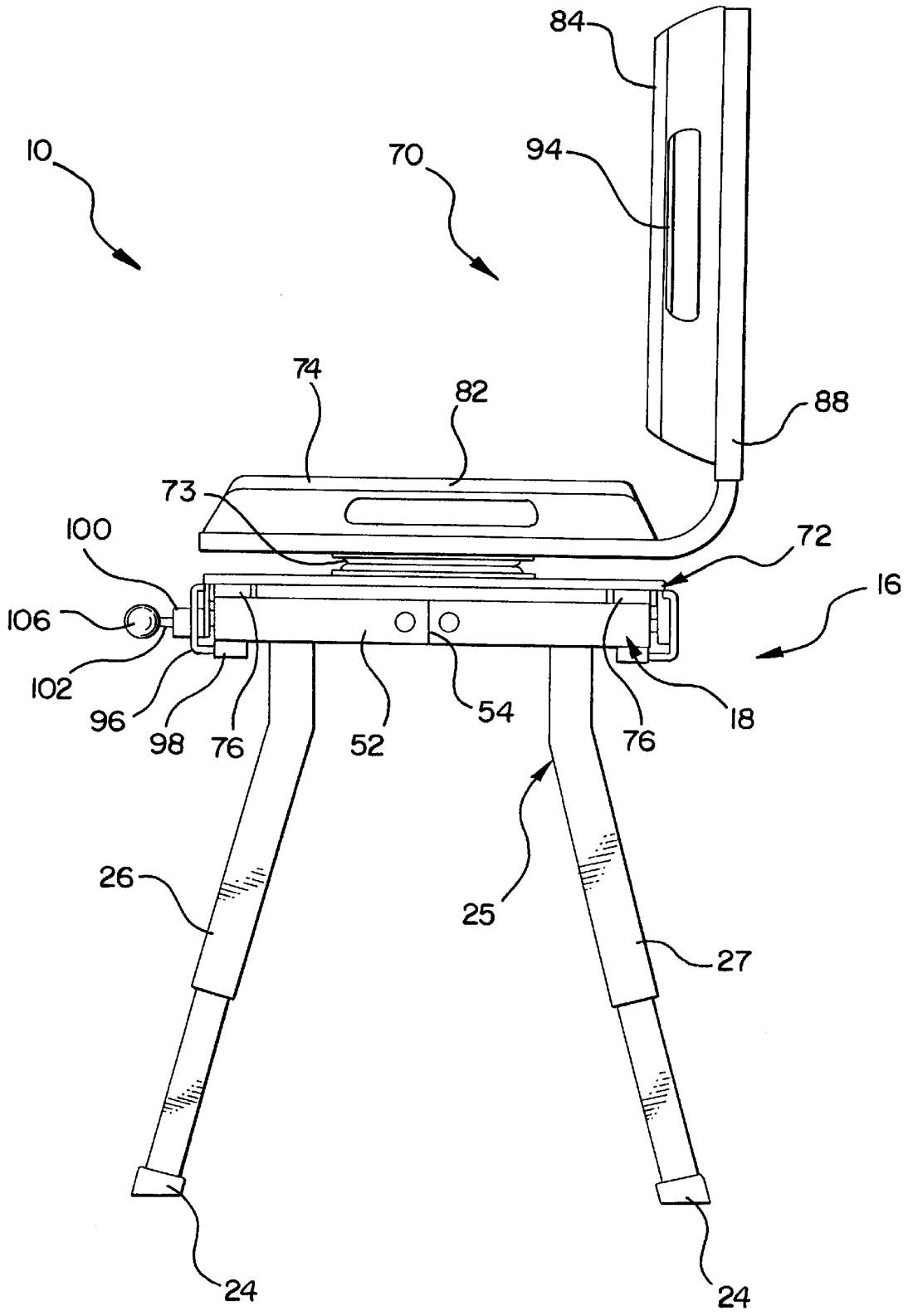
FIG. 4 is an end view of the bathing transfer trolley.
Figure 5:
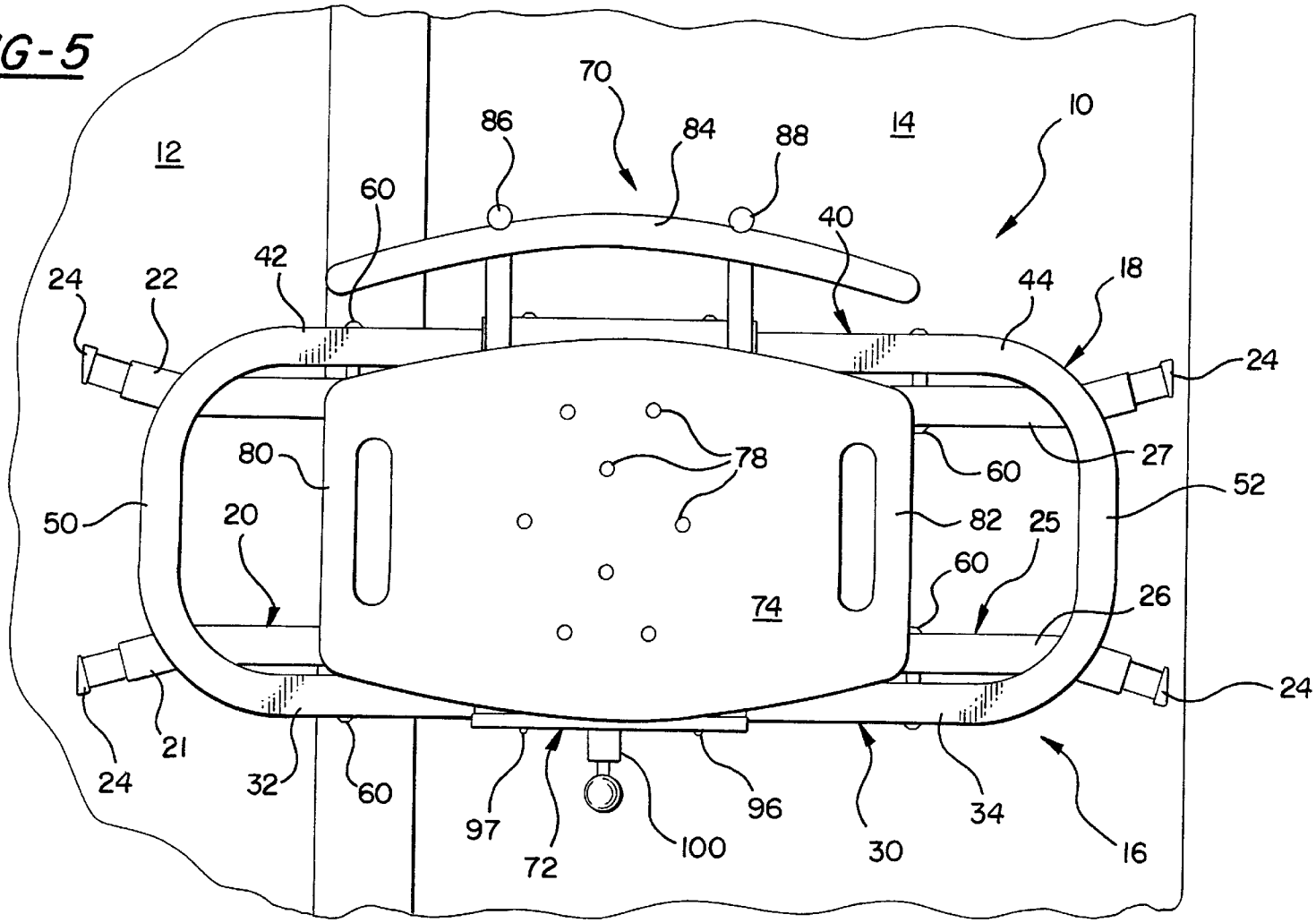
FIG. 5 is a top view of the bathing transfer trolley.

Referring to FIGS. 1–5, a preferred embodiment of the bathing transfer trolley according to the present invention is generally shown at 10. The bathing transfer trolley 10 is intended to facilitate movement of a seated person from a loading region 12 to a bathing region 14 located within a shower or over a bathtub where the person is showered. The loading region 12 and the bathing region 14 are generally indicated in FIGS. 3 and 5 as being inside and outside of a bathing tub. The bathing transfer trolley 10 has a frame 16 which includes a rail assembly 18 and two legs 20 and 25. When the bathing transfer trolley 10 is in its ready to use position, as best shown in FIG. 1, the rail assembly 18 is supported in a generally horizontal position by the legs 20 and 25. The legs 20 and 25 are pivotally attached to the rail assembly 18 so that they may be folded against the rail assembly 18 to ease storage and transport. The transfer trolley 10 in the ready to transport position with the legs 20 and 25 folded is shown in FIG. 2. A movable seat 70 is movably supported on the rail assembly 18 for movement between the loading region 12 and the bathing region 14.

The rail assembly 18 includes a first transfer rail segment 30 on the front side of the frame and a parallel second transfer rail segment 40 on the rear side of the frame. The transfer rail segments 30 and 40 are generally horizontal when the transfer trolley 10 is in the ready to use position, and extend transversely from the loading region 12 to the bathing region 14. The portions of the rail segments 30 and 40 located in the loading region 12 are defined as first portions 32 and 42 respectively. The portions of the rail segments 30 and 40 which are located in the bathing region 14 are defined as second portions 34 and 44 respectively.

In the most preferred embodiment, the rail assembly 18 also includes a first end segment 50 which is integral with and joins the first portion 32 of the first transfer rail segment 30 to the first portion 42 of the second transfer rail segment 40. Likewise, a second end segment 52 is integral with and joins the second portion 34 of the first transfer rail segment 30 to the second portion 44 of the second transfer rail segment 40. Therefore, with the transfer trolley 10 in the ready to use position, the first end segment 50 is located in the loading region 12 and the second end segment 52 is located in the bathing region 14. The rail assembly 18 is formed by bending a single piece of square aluminum tubing into the generally race track-shaped configuration shown in the Figures and joining the ends of the tubing at joint 54 as shown in FIG. 4. This creates a one piece rail assembly 18 which is lightweight and structurally strong and stiff. The bends in the tubing have smooth radiuses to optimize the strength of the rail assembly 18 and to avoid potentially dangerous sharp corners. The shape of the rail assembly 18 also makes it easy to pick up the transfer trolley 10 by the end segments 50 and 52.

The rail assembly 18 is supported in the generally horizontal position by two generally U-shaped legs 20 and 25 as best shown in FIGS. 1 and 2. The legs 20 and 25 are each pivotally attached to both transfer rail segments 30 and 40. Leg 20 and leg 25 are mirror images of one another, with each supporting one end of the rail assembly 18. Leg 20 will be described in detail but it should be understood that leg 25 is similar in all respects.

Leg 20 has a first leg segment 21 and a second leg segment 22 each terminating in resilient feet 24 at one of their ends and interconnected by a smoothly radiused connection segment 23 at their other end. The pivotal attachment of leg 20 to the transfer rail segments 30 and 40 is accomplished by pivotally attaching the first leg segment 21 to the first portion 32 of the first transfer rail segment 30 and pivotally attaching the second leg segment 22 to the first portion 42 of the second transfer rail segment 40. A pin 60 passes through first leg segment 21 adjacent where leg segment 21 is interconnected to the connection segment 23, and passes through the first portion 32 of the first transfer rail segment 30. A pin 60 also passes through second leg segment 22 adjacent the interconnection to connection segment 23, and passes through the first portion 42 of the second transfer rail segment 40. The leg segments 21 and 22 extend from connection segment 23 downwardly and terminate in the resilient feet 24. The connection segment 23 and the portions of the leg segments 21 and 22 adjacent the connection segment 23 reside between the first transfer rail segment 30 and the second transfer rail segment 40. The leg segments 21 and 22 are bent such that the connection segment 23 and the portions of the leg segments 21 and 22 adjacent the connection segment 23 occupy a generally horizontal plane and are coplanar with the rail assembly 18 when the transfer trolley 10 is in the ready to use position. When the legs 20 and 25 are folded against the rail assembly 18, putting the transfer trolley 10 into the ready to transport position, as shown in FIG. 2, the connection segment 23 and the portions of the leg segments 21 and 22 adjacent the connection segment 23 are rotated on pins 60 to a position out of the plane of the rail assembly 18. This causes the connection segment 23 to project upwardly from the rail assembly 18 and the legs 20 and 25 to reside close to the plane of the rail assembly 18. With the transfer trolley 10 in the ready to use position, the leg segments 21 and 22 extend from the connection segment 23, past the pins 60, bend downwardly and outwardly, and terminate in resilient feet 24. By bending downwardly and outwardly, the leg segments 21 and 22 place the resilient feet 24 wider apart to the front and rear of the transfer trolley 10 and further into the loading region 12. This creates a wide stance for the transfer trolley 10 to both the front and the rear and to the sides. The fact leg 20 is narrower where it connects to the rail assembly 18 then at the feet 24 and connects between the rail segments 30 and 40 also prevents interference between leg 20 near the rail assembly 18 and an occupant or user of the transfer trolley 10.

Leg 25 also includes a first leg segment 26 and a second leg segment 27 each terminating in resilient feet 24 at one of their ends and interconnected by a connection segment 28 at their other end.

The leg segments 21, 22, 26, and 27 are adjustable in length to allow the transfer trolley to be used where a support surface in the bathing region 14 is a different height than the support surface in the loading region 14. This adjustability is preferably accomplished by forming each leg segment 21, 22, 26, and 27 from two pieces of differently sized square aluminum tubing. The aluminum tubing which forms the lower part of each leg segment 21, 22, 26, and 27 is sufficiently smaller than the upper portion of each leg segment 21, 22, 26, and 27 so as to allow the lower portion to slide into the upper portion. The upper portion has a plurality of holes defined therethrough. The lower portion is then locked into a given position relative to the upper portion by any of several well known means such as a spring loaded lock pin or a bolt passing through one of the plurality of holes and through a matching hole in the lower portion. When the leg segments are properly adjusted, the second end segment 52 of the rail assembly is slightly lower than the first end segment 50 so that water running off of the rail assembly 18 falls into the bathing region 14. The adjustability of the leg segments 21, 22, 26, and 27 also allows the height of the transfer trolley 10 to be adjusted to accommodate a variety of patient heights and necessary clearances for bathing regions. Alternatively, the bathing transfer trolley 10 could be constructed with 3 or 4 individual legs, each pivotally connected to the rail assembly 18.

The resilient feet 24 are formed from a non-slip material and shaped to sit securely on a support surface. Alternatively, the feet 24 may provide suction cups.

The movable seat 70 includes a base 72 which has a pivot 73 supporting a seat bottom 74. The base 72 is supported for transverse motion on the transfer rail segments 30 and 40 and includes a total of four rollers 76 (two rollers visible in FIG. 4) rotationally mounted to its underside. Two rollers 76 under the front edge of the base 72 engage the first transfer rail segment 30 and two rollers 76 under the rear edge of the base 72 engage the second transfer rail segment 40. The roller 76 as best shown in FIG. 8 are spool shaped and made out of plastic. Preferably they are made up of five pieces; two end pieces 122 and 124, and three center sections 126, 128 and 130, all sharing a common bore 132. These sections 122–130 are all cylindrical but the center sections 126–130 have a smaller diameter than the end sections 122, 124. The combined width of the center sections 126–130 is approximately equal to the width of the transfer rail segments 30 and 40. This allows the center sections 126–130 to engage the top surface of one of the transfer rail segments 30 or 40 while the end sections 122 and 124 rest on either side of the same transfer rail segment 30 or 40. This configuration securely positions the roller 76 on one of the transfer rail segments 30 or 40 and prevents the movable seat 70 from rolling off the end of the rail assembly 18. The movable seat 70 is moved to the end of the transfer rail segments 30 and 40, one of the end sections 122 or 124 of the roller 76 comes into contact with the inside of the smoothly radiused bends of one of the end segments 50 or 52 of the rail assembly 18. Assembling the roller 76 from multiple pieces prevents the roller 76 from binding if any one section stops rotating as easily as the other sections. The common bore 132 fits over and rotates on a shaft (not shown) on the underside of the base 72.

The roller mounted base 72 allows the movable seat 70 to be easily moved transversely along the transfer rail segments 30 and 40 from the loading region 12 to the bathing region 14.

The pivot 73 is supported on and secured to the upper side of base 72 and supports the seat bottom 74. Pivot 73 is preferably of the type well known in the art including an upper and a lower metal plate mounted on a common bolt, rivet, or pin. At least one of the two plates includes a radial groove in which reside a plurality of ball bearings. In the present invention, the lower plate of the pivot 73 is mounted to the base 72 and the upper plate of the pivot 73 is mounted to the seat bottom 74. This allows the seat bottom 74 to be rotated about a vertical axis. This simplifies the process of getting onto and off of the seat bottom 74 since it can be rotated into an orientation facing the user. The pivot 73 preferably has some resistance so that the seat bottom 74 remains in whatever pivotal orientation it is placed. In the present invention, pivoting resistance is incorporated by preloading the upper and lower plates of the pivot 73 to one another.

The seat bottom 74 is wider than it is deep and is curved such that the center portion is lower than the sides. The seat bottom 74 is molded plastic and includes a plurality of drain holes 78 defined therethrough and a pair of integral handles 80 and 82. Bolts pass through four of the drain holes 78 and are used to fasten the seat bottom 74 to the upper plate of the pivot 73. The remainder of the drain holes 78 prevent water accumulation under a patient using the seat. The integral handles 80 and 82 are defined by oblonged holes through each side of the seat bottom 74 adjacent and parallel to the side edges. The portion of the seat bottom 74 between each oblong hole 80 or 82 and the edge of the seat bottom 74 can be gripped by a patient by passing their hand around the edge of the seat bottom 74 and passing their fingers through the oblong hole. The handles 80 and 82 may be gripped by either the patient or by an assistant to steady the patient or to move the movable seat 70 along the transfer rail segments 30 and 40.

Preferably, the seat bottom 74 slopes back approximately 3 degrees so that the front edge is higher than the back edge. This improves comfort and drainage and helps secure the patient in the seat 70. The slope is incorporated by using a pivot 73 which has an upper plate that slopes with respect to the lower plate. Preferably, the movable seat 70 further includes a removable seat back 84 supported generally perpendicular to the seat bottom 74 by a pair of L shaped tubular support brackets 86 and 88. Support brackets 86 and 88 attached to the underside of the seat bottom 74, extend rearwardly and bend upwardly and connect to the back side of the seat back 84. The seat back 84 is preferably identical to the seat bottom 74 and includes drain holes 90 and integral handles 92 and 94. The L shaped tubular support brackets 86 and 88 are each preferably formed as two pieces so that the seat back 84 may be detached as best shown in FIG. 2. Like the leg segments 21, 22, 26, and 27, the support brackets 86 and 88 are formed from two different sizes of tubing so that one part of each support bracket 86 and 88 fits within the other piece of the corresponding support bracket. The upper piece of the support brackets 86 and 88 each have holes defined therethrough which cooperate with spring loaded lock pins in the lower pieces of the support brackets 86 and 88. The detachability of the seat back 84 makes the transfer trolley 10 easier to transport and store. Alternatively, the seat bottom 74 and seat back 84 could be formed as one piece or the support brackets 86 and 88 could include hinged portions so that the seat back 84 folds down onto the seat bottom 74.

The base 72 of the movable seat 70 further includes a tipping prevention device to prevent the movable seat 70 from being accidentally tipped off of the rail assembly 18. The tipping prevention device comprises a first bracket 96 and a second bracket 97 which each extend from a flange which extends downwardly from the front edge of the base 72 to a position beneath the first transfer rail segment 30. Rollers 98 and 99 are supported on the brackets 96 and 97 in the position below the first transfer rail segment 30. If the movable seat 70 begins to tip off of the rail assembly 18, the base 72 is lifted upwardly causing the rollers 98 and 99 to come into contact with the underside of the first transfer rail segment 30. Most preferably, the base 72 further includes an identical second set of brackets connected to a downwardly extending flange of the back edge of the base 72 and rollers located at a position beneath the second transfer rail segment 40 as best shown in FIG. 4.

The base 72 of the movable seat 70 further includes a locking device 100 for locking the movable seat 70 in the loading region 12 or the bathing region 14. Referring now to FIGS. 6 and 7, the preferred locking device 100 consists of a locking pin 102 which extends through a mounting block 104 and terminates in a plastic knob 106. The locking pin 102 is urged into a position where the pin 102 extends from the mounting block 104, as shown in FIG. 6, by a spring 108. The first transfer rail 30 has locking holes 110 and 112 defined therein. The locking device 100 is installed by mounting the mounting block to the flange extending downwardly from the front edge of base 72. The locking pin 102 is then urged into locking engagement with locking hole 110 or 112 according to the position of the movable seat 70. When the locking pin engages one of the locking holes 110 or 112 the movable seat 70 is retained in either the loading region 12 or the bathing region 14 until the plastic knob 106 is pulled thereby disengaging the locking pin 102 from hole 110 or 112.

In use, the movable seat 70 is first moved to loading region 12 where the locking device 100 is allowed to lock the movable seat 70 in that position. The movable seat 70 can then be pivoted to whatever orientation makes loading most convenient. The person with a physical impairment then is seated on the movable seat 70. An optional strap 120 may be used to secure the patient to the movable seat 70 to prevent them from falling off. The patient or an assistant then pulls on plastic knob 106 thereby unlocking the locking device 100. The movable seat 70 is pushed along the transfer rails 30 and 40 until the movable seat 70 and the patient are located in the bathing region 14 and the locking device engages locking hole 112. The patient then bathes and the process is reversed to move the patient from the bathing region 14 to the loading region 12.

After use, someone may wish to move or store the transfer trolley 10. To do so, the movable seat 70 is first moved to a position approximately midway along the transfer rail segments 30 and 40. The legs 20 and 25 are then pivoted on pins 60 so that the leg segments 21, 22, 26, and 27 are folded against the rail assembly 18. The seat back 84 is then removed from the movable seat 70. It may be conveniently placed on top of the seat bottom 74 as shown in FIG. 2. The transfer trolley 10 may then be picked up by either grabbing the connection segments 23 and 28 of the legs 20 and 25 or the end segments 50 and 52 of the rail assembly 18. Because the connection segments 23 and 28 of the legs 20 and 25 extend upwardly from the rail assembly 18 when folded, the movable seat 70 is prevented from moving very far along the transfer rail segments 30 and 40. To prepare the transfer trolley 10 for use again, the above folding process is simply reversed.

In view of the teaching presented herein, other modifications and variations of the present invention will be readily apparent to those of skill in the art. The foregoing drawings, discussion, and description are illustrative of some embodiments of the present invention; but are not meant to be limitations on the practice thereof. It is the following claims, including all equivalents, which define the scope of the invention.

I claim:

1. A bathing transfer trolley for transferring a person from a loading region to a bathing region, said trolley comprising:

a frame including a rail assembly, said rail assembly comprising a first and a second transfer rail segment, said rail segments having first portions located within the loading region and second portions located within the bathing region, said frame further including at least two legs for supporting said rail assembly in a generally horizontal position; and a movable seat including a base and a seat bottom supported by said base for rotation about a vertical axis, said base including two rollers for engaging each of said transfer rail segments such that said movable seat is movable along said rail segments from the loading region to the bathing region.

2. The bathing transfer trolley of claim 1, wherein said legs are pivotally attached to said rail assembly so that said legs may be folded against said rail assembly to ease storage and transport of said bathing trolley.

3. The bathing transfer trolley of claim 1, wherein said at least two legs comprise two pairs of legs.

4. The bathing transfer trolley of claim 1, wherein said legs comprise two u-shaped legs, each of said u-shaped legs comprising a first and a second leg segment interconnected by a connection segment, said leg segments being pivotally attached to said rail assembly.

5. The bathing transfer trolley of claim 1, wherein said leg segments angle outwardly from said rail assembly.

6. The bathing transfer trolley of claim 1, wherein said seat bottom includes integral handles.

7. The bathing transfer trolley of claim 1, wherein said movable seat further comprises a seat back supported generally perpendicular to said seat bottom.

8. The bathing transfer trolley of claim 7, wherein said seat back includes integral handles.

9. The bathing transfer trolley of claim 7, wherein said seat back is detachable.

10. The bathing transfer trolley of claim 1, wherein said seat bottom includes drain holes defined therethrough.

11. The bathing transfer trolley of claim 1, wherein said base includes a locking device for selectively locking said movable seat in at least one of said loading region and said bathing region.

12. The bathing transfer trolley of claim 11, wherein one of said transfer rail segments has a locking hole defined therein; and said locking device comprises a locking pin for engaging said locking hole.

13. The bathing transfer trolley of claim 1, wherein said base further includes a tipping prevention device for preventing said seat from tipping off of said rail assembly.

14. The bathing transfer trolley of claim 13, wherein said tipping prevention device comprises a first and a second bracket each extending from said base to a position beneath one of said transfer rail segments.

15. The bathing transfer trolley of claim 14, wherein said tipping prevention device further comprises a roller supported by each of said brackets in the position beneath one of said transfer rail segments.

16. A bathing transfer trolley for transferring a person from a loading region to a bathing region, said trolley comprising:

a frame including a rail assembly, said rail assembly comprising first and second transfer rail segments having first portions located within said loading region and second portions located within said bathing region, said rail assembly further including first and second end segments, said first end segment integral with and joining said first portions of said first and second transfer rail segments, said second end segment integral with and joining said second portions of said first and second transfer rail segments, said frame further comprising two legs for supporting said rail assembly in a generally horizontal position, said legs being pivotally attached to said rail assembly so that said legs may be folded against said rail assembly to ease storage and transport of said bathing transfer trolley; and a movable seat including a base and a seat bottom supported by said base, said base including two rollers for engaging each of said transfer rail segment such that said movable seat is movable along said transfer rail segments from the loading region to the bathing region.

17. The bathing transfer trolley of claim 16, wherein said seat bottom is supported by said base for rotation about a vertical axis.

18. The bathing transfer trolley of claim 16, wherein said movable seat further comprises a seat back supported generally perpendicular to said seat bottom.

19. The bathing transfer trolley of claim 18, wherein said seat back is detachable.

20. The bathing transfer trolley of claim 1, wherein said legs comprise two u-shaped legs, each of said u-shaped legs comprising a first and a second leg segment interconnected by a connection segment, said leg segments being pivotally attached to said rail assembly.

21. The bathing transfer trolley of claim 20, wherein said leg segments angle outwardly from said rail assembly.

* * * * *